US006416650B1

(12) United States Patent
Ho

(10) Patent No.: US 6,416,650 B1
(45) Date of Patent: Jul. 9, 2002

(54) APPARATUS AND METHOD OF ELECTROCHEMICAL POLISHING BY RING-FORM ELECTRODE

(75) Inventor: Cheng-Hong Ho, Hsinchu (TW)

(73) Assignee: National Science Council, Taipei (TW)

( * ) Notice: Subject to any disclaimer, the term of this patent is extended or adjusted under 35 U.S.C. 154(b) by 19 days.

(21) Appl. No.: 09/625,836

(22) Filed: Jul. 27, 2000

(30) Foreign Application Priority Data

Aug. 6, 1999 (TW) ..... 88113437 A

(51) Int. Cl.[7] ..... C25F 3/16; C25D 17/00

(52) U.S. Cl. ..... 205/640; 205/659; 205/670; 205/685; 205/686; 204/212; 204/224 M; 204/225; 204/238

(58) Field of Search ..... 204/224 M, 240, 204/212, 238, 225; 205/640, 686, 685

(56) References Cited

U.S. PATENT DOCUMENTS 3,642,601 A * 2/1972 Kondo ..... 204/206

5,972,180 A * 10/1999 Chujo ..... 204/224 M

* cited by examiner

*Primary Examiner*—Donald R. Valentine
(74) *Attorney, Agent, or Firm*—Christensen O'Connor; Johnson Kindness PLLC

(57) ABSTRACT

An apparatus and method of electrochemical polishing a workpiece with ring-form electrode is provided. A mechanism with a tool electrode, a DC power supply and electrolysis-supply tank of the present invention can be installed on the traditional production equipment. The tool electrode is connected with the negative pole of the DC power supply, while the workpiece is connected with the positive pole of the DC power supply and kept a fixed distance from the tool electrode. The electrode or the workpiece advances at a predetermined feeding speed while the workpiece is electrochemically polished. The present invention uses the centrifugal force of rotational tool electrode to discharge electrolytic byproducts, making electrochemical polishing more effective.

18 Claims, 4 Drawing Sheets

APPARATUS AND METHOD OF ELECTROCHEMICAL POLISHING BY RING-FORM ELECTRODE

FIELD OF THE INVENTION

The invention relates to an apparatus and method of electrochemical polishing utilizing a ring-form electrode, and in particular to an apparatus and method capable of electrochemical polishing a workpiece continuously processed by a shaping machine.

DESCRIPTION OF THE RELATED ART

In the conventional techniques, after a workpiece has been through a shaping process, such as rolling, extrusion and drawing, etc., manual polishing or mechanical burnishing is performed to complete the surface treatment. However, the effectiveness of manual polishing is limited by the experience of the operator, and the man-hours and cost are relatively high. In addition, the contact pressure between the tools used and the workpiece is not so easily controlled during manual polishing or mechanical burnishing, causing the local generation of non-uniform residual stress on the surface of the workpiece. The residual stress is usually higher than the maximum strength of the workpiece; therefore, the surface of the workpiece may collapse and cause the formation of small cavities on the surface of the workpiece. Thus, the life of the workpiece is reduced. In addition, it is difficult to find operators with the technique and experience needed for manual polishing in today's society. Mechanical burnishing is limited by the shape and characteristics of the machine; as a result, its application is very limited and inconvenient.

Electrochemical processing uses a combination of electric energy and chemical energy. In the electrochemical processing, electrolyte is supplied to the space between the workpiece, connected with the positive pole of the DC power supply, and the tool electrode, connected with the negative pole. The circulation of the electrolyte serves the secondary purpose of removing electrolytic byproducts generated during the electrochemical processing. This method is suitable for materials with high hardness, heat-resistance or corrosion resistance.

Electrochemical polishing is a technique using electrochemical processing to reduce the roughness of the workpiece. It can be applied in research or industry as a highly efficient surface treatment method to obtain a high-quality workpiece without residual stress or burrs.

However, electrochemical polishing is presently limited in application to stainless steel which has been mechanical processed in order to smooth cavities on the surface of the workpiece and prevent the residue from remaining on the surface of the workpiece. The workpiece has better effect about corrosion resisting after electrochemical polishing. However, after such workpiece has been processed by the traditional electrochemical polishing, it must be put in an additional electrolytic tank; hence, the polishing time is much longer and the amount of material removed from the workpiece is extremely little.

Nevertheless, the labor savings and accuracy of electrochemical polishing have lead to continued investigation into its application. Electrochemical techniques such as electrochemical drilling, electrochemical grinding and electrochemical deburring, etc, have been developed. A Japanese company has developed an apparatus for the electrochemical polishing of materials other than stainless steel. However, because the cost of such an apparatus is very expensive and the design of its electrode is very difficult, its practical application is still limited.

SUMMARY OF THE INVENTION

In view of the disadvantages of the conventional electrochemical polishing technique, an object of the invention is to provide an electrochemical polishing method and its apparatus using a rotatable ring-form electrode. It offers advantages of economical equipment, a minimum-polluting and low-cost process, and easy assembly and automation. Bars and tubes, produced by traditional machining techniques, for example, turning, drawing, rolling, and extrusion, can be continuously processed by the apparatus of the present invention. A mechanism with a tool electrode, a DC power supply and an electrolysis-supply tank of the present invention can be installed on the traditional production equipment. The tool electrode is connected with the negative pole of the DC power supply, while the workpiece is connected with the positive pole of the DC power supply and kept a fixed distance from the tool electrode. The electrode or the workpiece advances at a predetermined feeding speed while the workpiece is electrochemically polished. The present invention uses the centrifugal force of rotational tool electrode to discharge electrolytic byproducts, making electrochemical polishing more effective. The present invention is also designed to obtain fast improvement of the surface roughness of the workpiece, and to effectively reduce residual stress.

Another purpose of the present invention is to provide an electrode-supporting mechanism with a low-cost tool electrode, easy assembly and rotational power. For the workpiece with circular shape, such as circular tubes or circular rods, the electrode-supporting mechanism of the present invention can be rotated and use the centrifugal force of the rotational tool electrode to discharge the electrolytic byproducts, which makes electrochemical polishing more effective.

Furthermore, another purpose of the present invention is to provide an electrochemical polishing method. The DC power supply, the electrolyte-supplying tank, a pump, a filter and a tube of the present invention can be installed on traditional equipment for drawing, rolling, or extrusion and so on. During electrochemical polishing, the tool electrode is connected with the negative pole of the DC supply power, while the workpiece is connected with the positive pole of the DC supply power. The size of the inner diameter of the ring-from electrode is 0.2~1.0 mm bigger than the outer diameter of the workpiece. The electrolyte is a solution comprising 20%~40% of NaCl or $NaNO_3$. The feeding speed of the electrode is about 1.5~2.5 mm/min, the rating current is about 5~10 mm/min when the average diameter of the workpiece is 10 mm, the voltage is about 10~15V, and the width of the pulse is about several to several tenths of a sec.

BRIEF DESCRIPTION OF THE DRAWINGS

The invention is hereinafter described in detail by reference to the accompanying drawings in which.

DETAILED DESCRIPTION OF THE INVENTION

Figure 1:
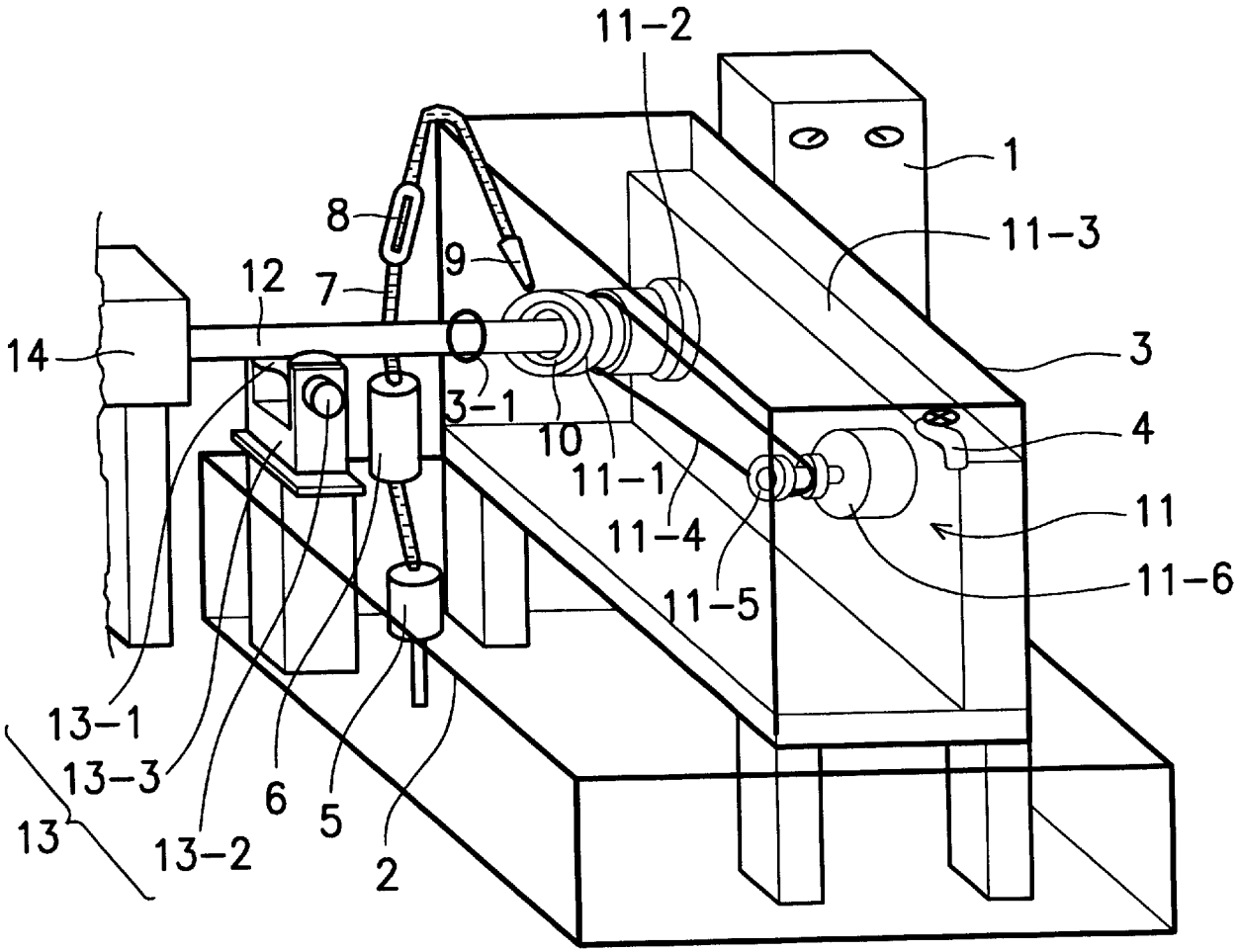
FIG. 1 is a schematic view showing the structure of the present invention assembled on an apparatus used to extrude a circular rod.

Referring to FIG. 1, the structure of an embodiment of the present invention consists of a DC power supply 1, a first electrolyte-supplying tank 2, a second electrolyte-supplying tank 3, a tool electrode (a ring-form electrode) 10, a supporting mechanism 11 and a feeding mechanism 13.

The current, voltage and pulse values of the DC power supply 1 are adjustable. A positive pole of the DC power supply 1 is connected with a shaping machine 14 connected electrically with the workpiece 12. A negative pole of the DC power supply 1 is connected with a base 11-3 of the supporting mechanism 11.

Electrolyte with proper concentration is loaded inside the first electrolyte-supplying tank 2. The electrolyte is a solution preferably comprising 20%~40% of NaCl or $NaNO_3$. The electrolyte is pumped by a pump 5, is filtered by a filter 6, flows through a tube 7, a flow meter 8, is sprayed to a gap between the tool electrode 10 and the workpiece 12 by a nozzle 9, and flows into the second electrolyte-supplying tank 3. The flow rate of the flow meter 8 is preferably above 4 l/min, and the gap is preferably 0.3 mm. After the height of the electrolyte inside the second electrolyte-supplying tank 3 is higher than the height of the workpiece 12, the electrolyte will flow back into the first electrolyte-supplying tank 2 through a drain valve 4. An electrolyte-supplying device of the present invention consists of the first electrolyte supplying tank 2, the electrolyte supplying tank 3, the drain valve 4, the pump 5, the filter 6, the tube 7, and the nozzle 9.

The supporting mechanism 11 comprises a sleeve 11-1, provided with an annular groove and disposed inside a bearing 11-2, for the tool electrode 10 disposed therein. The bearing 11-2 is fixed on a base 11-3. A belt 11-4 is put around the annular groove of the sleeve 11-1; therefore, a belt pulley 11-5, connected with a second motor 11-6, rotates when the second motor 11-6 rotates. Meanwhile, the belt 11-4 is activated to force the sleeve 11-1 and the tool electrode 10 to rotate in order to polish the workpiece, wherein the effect of removing the electrolytic byproducts is obtained as a secondary benefit. The rotational speed of the second motor 11-6 is about several hundreds rpm. In summary, the supporting mechanism 11 of the present invention consists of the sleeve 11-1, the bearing 11-2, the base 11-3, the belt 11-4, the belt pulley 11-5, and the second motor 11-6.

The feeding mechanism 13 consists of a feed roller 13-1, a first motor 13-2 and a support 13-3. After the shaping machine 14 has shaped the workpiece 12, it is supported on the feed roller 13-1 of the feeding mechanism 13. The rotational speed of the feed roller 13-1 depends on the first motor 13-2. The workpiece 12 is fed into an entrance 3-1, of the second electrolyte-supplying tank 3, and the tool electrode 10 by means of the first motor 13-2.

After the traditional shaping machine has shaped the workpiece, the surface of the workpiece needs to be polished. The steps of the processing method are described in detail as follows:

Step 1: The positive pole of the DC power supply 1 is connected with the shaping machine 14, electrically connected with the workpiece 12. The negative pole of the DC power supply 1 is connected with the metal base 11-3 of the supporting mechanism 11.

Step 2: The voltage, rating current, pulse values of the DC power supply 1 are selected as follow: the voltage is about 10~15V, the rating current is about 5~15A when the average diameter of the workpiece is 10 mm, and the width of the pulse value is several to several tenths of a second.

Figure 2:
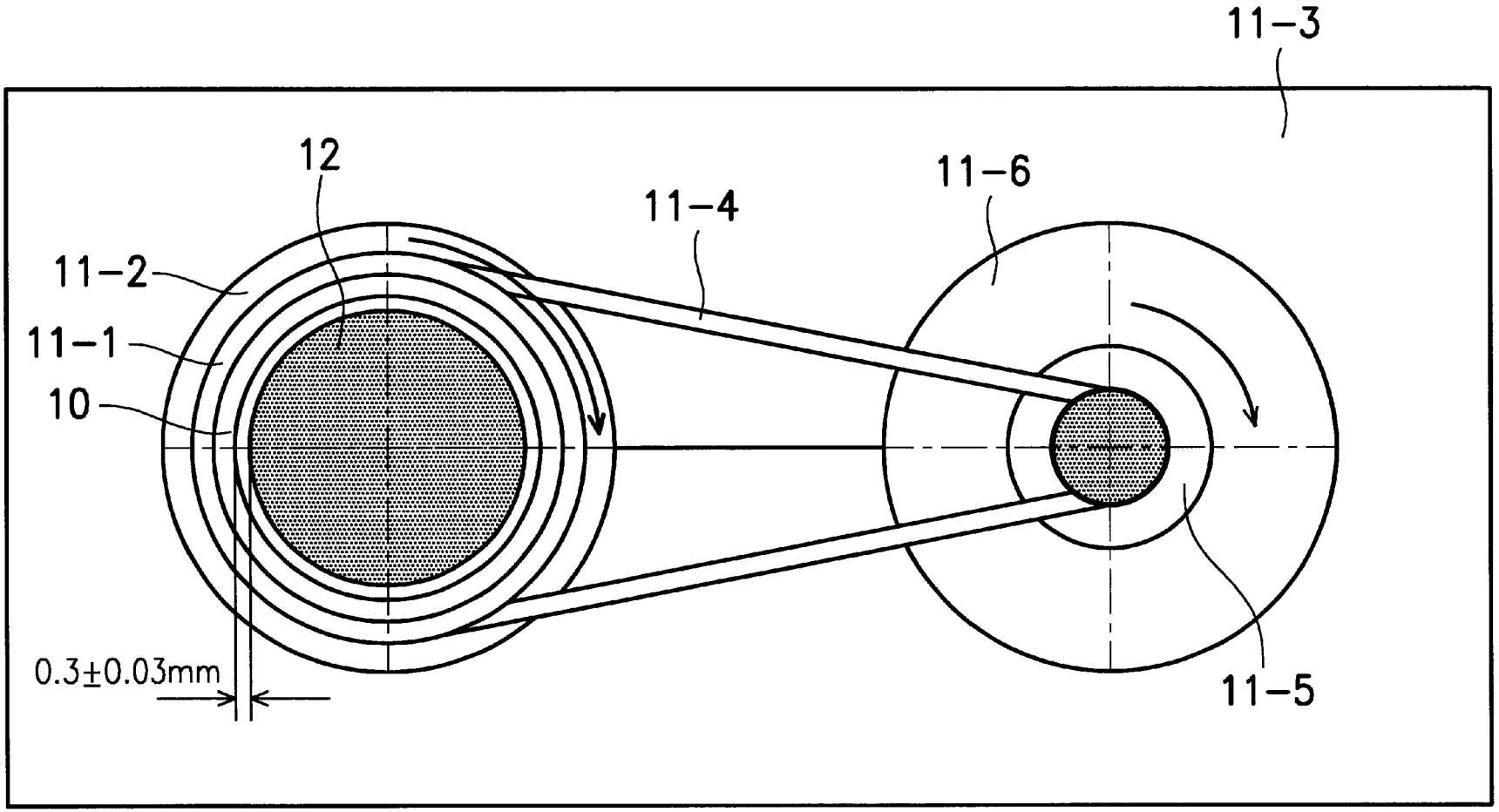
FIG. 2 is a schematic view showing the relative position between the tool electrode and the workpiece during the electrochemical polishing.

Step 3: The shape and size of the required tool electrode 10 is predetermined. The inner diameter of the tool electrode 10 is 0.3 mm bigger than the outer diameter of the workpiece, as shown in FIG. 2.

Step 4: The predetermined tool electrode 10 is mounted inside the sleeve 11-1 of the supporting mechanism 11. If the workpiece 12 is a circular rod or a circular tube, the rotational speed of the second motor 11-6 can be adjusted to, for example, at least 200 rpm. When the second motor 11-6 rotates, the belt pulley 11-5, connected with the second motor 11-6, rotates. The belt 11-4 forces the sleeve 11-1 and the tool electrode 10, disposed inside the sleeve 11-1, to rotate to attain polish the workpiece, wherein the effect of removing the electrolytic byproducts during the electrochemical polishing is a secondary benefit.

Step 5: The electrolyte, for example, NaCl or $NaNO_3$, with proper concentration, for example, 20~40%, is put into the first electrolyte-supplying tank 2. The electrolyte is blended uniformly, and its height inside the second electrolyte-supplying tank 3 is higher than the height of the workpiece 12. The electrolyte from the nozzle 9 is aimed at the gap between the workpiece 12 and the tool electrode 10 to remove the electrolytic byproducts during the electrochemical polishing.

Step 6: The flow rate of the electrolyte through the drain valve 4 of the second electrolyte-supplying tank 3 is above 4 l/min preferably to maintain the height of the electrolyte inside the second electrolyte-supplying tank 3 during the electrochemical polishing. The electrolyte flows through the drain valve 4 into the first electrolyte-supplying tank 2. By means of the pump 5, it continuously flows back to the second electrolyte-supplying tank 3 through the filter 6, the tube 7, the flow meter 8 and the nozzle 9.

Step 7: The rotational speed of the first motor 13-2 of the feeding mechanism 13 is adjusted to provide a proper feeding speed of the workpiece 12, for example, several millimeters per minute.

Step 8: The DC power supply 1 and the pump 5 is activated to supply the electrolyte into the second electrolyte-supplying tank 3 and keep the height of the electrolyte inside the second electrolyte supplying tank 3 higher than the height of the workpiece. Meanwhile, the first motor 13-2 of the feeding mechanism 13 is activated.

Step 9: The shaping machine 14 is activated to shape the workpiece 12 into a predetermined shape. Then, the workpiece 12 is supported by the feed roller 13-1 of the feeding mechanism 13, fed into the tool electrode 10 of the second electrolyte-supplying tank 3 to be electrochemically polished.

Figure 3C:
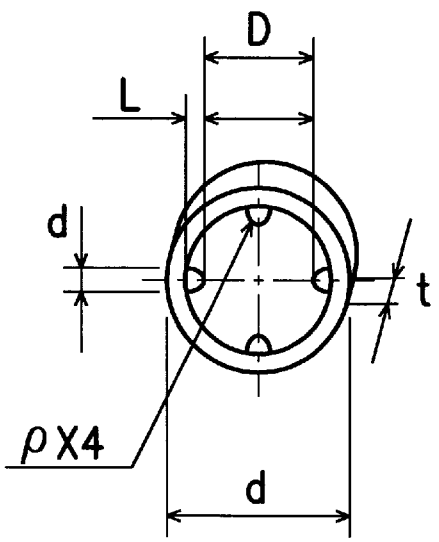
FIG. 3A, FIG. 3B and FIG. 3C are schematic diagrams showing various types of the tool electrodes.
Figure 3B:
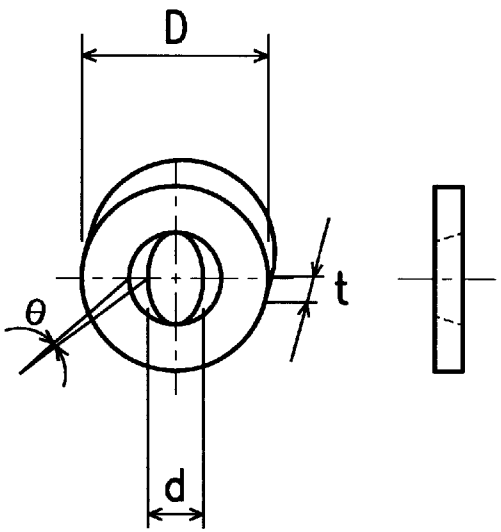
Figure 3A:
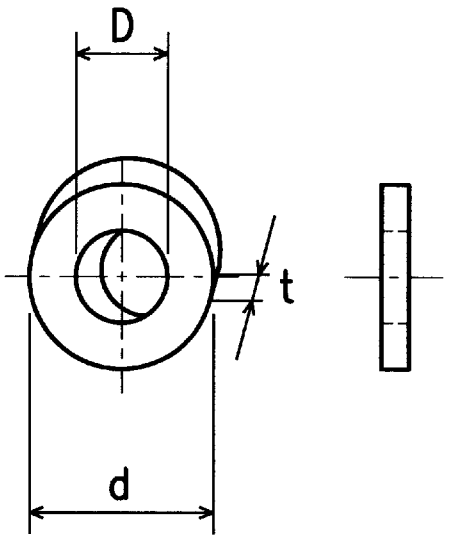

FIG. 3A, FIG. 3B and FIG. 3C are schematic diagrams showing various types of the tool electrode of the present invention. Among them, the tool electrode shown in FIG. 3A is a basic type, the shape of the inner portion of the tool electrode shown in FIG. 3B is tapered, and the inner portion of the tool electrode shown in FIG. 3C is provided with several convex pins.

Figure 4:
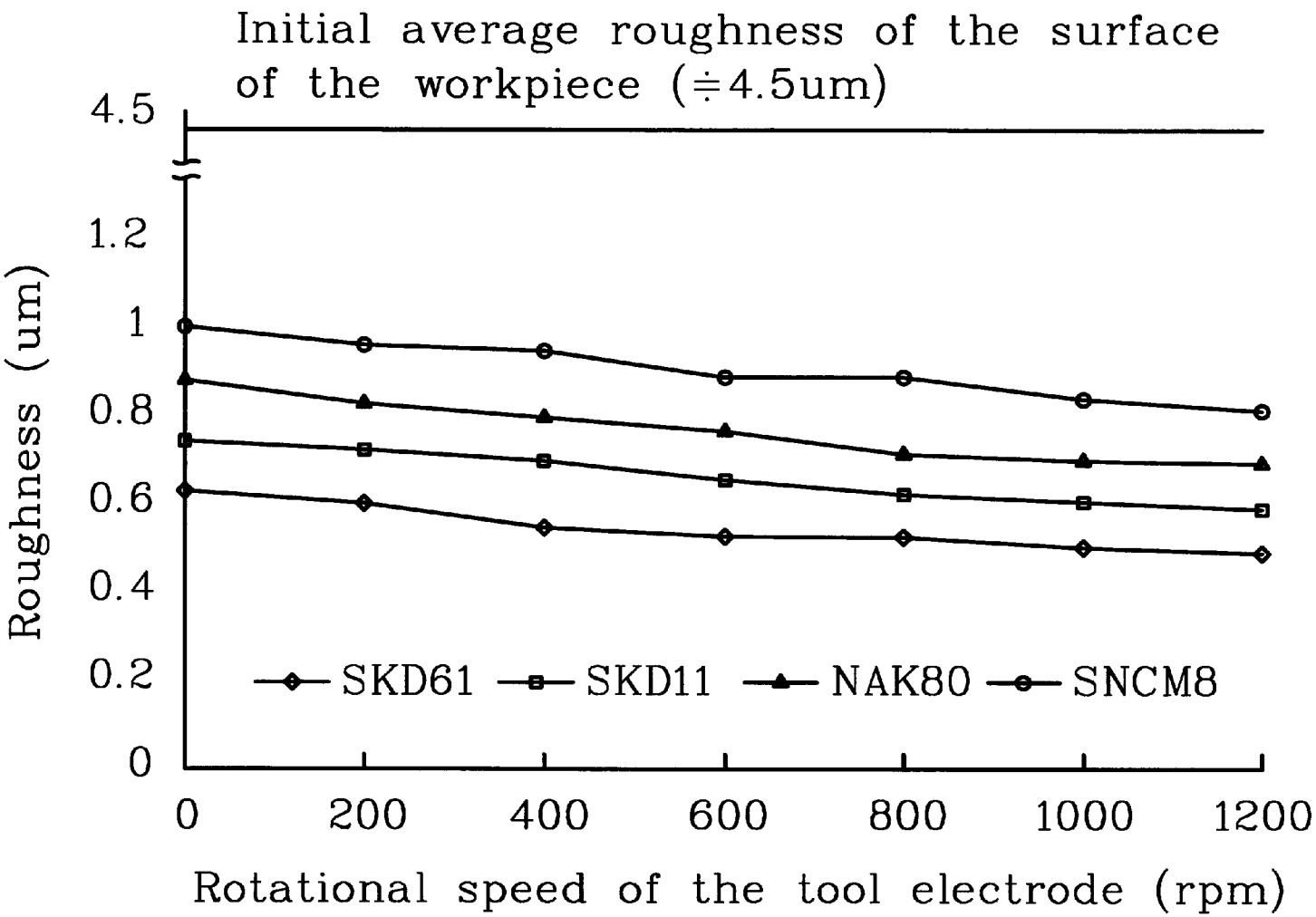
FIG. 4 is a graph showing the experimental results of the present invention.

The experimental results with four different mold materials using the electrochemically polished with the method of the present invention are shown in FIG. 4. From the graph in FIG. 4, it can be seen that the roughness of the surface of the workpiece undergoing the method of the present invention is improved. Table 1 provides the difference between the roughness of the workpiece processed by the method with the electrode rotating and the roughness of the workpiece processed by the method without the electrode rotating in order to prove that the method with the electrode rotating has the advantage of enhancing the polishing effect.

TABLE 1

| | SKD61 | SKD11 | NAK80 | SNCM8 |
|---|---|---|---|---|
| Relative improvement ratio (%) | 20 | 20 | 19 | 18 |

While the present invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. An apparatus adapted for electrochemical polishing a workpiece, the workpiece being continuously processed by a shaping machine, the apparatus comprising:

a device for supplying an electrolytic solution to polish the workpiece, the device including:

a first tank having a periphery and being adapted for containing the electrolytic solution;

a pump disposed within the periphery of the first tank and being adapted for pumping the electrolytic solution from the first tank to produce a pumped electrolytic solution;

a filter fluidly coupled with the pump and being adapted for filtering the pumped electrolytic solution to produce a filtered electrolytic solution;

a tube fluidly coupled with the filter for conducting the filtered electrolytic solution;

a nozzle fluidly coupled with the tube and being adapted for spraying the filtered electrolytic solution to produce a sprayed electrolytic solution;

a second tank disposed within the first periphery of the first tank and being adapted for collecting the sprayed electrolytic solution; and a drain valve fluidly coupled with the second tank and being adapted for regulating the volume of the sprayed electrolytic solution in the second tank by allowing the sprayed electrolytic solution to flow back to the first tank such that the height of the sprayed electrolytic solution inside the second tank is higher than the height of the workpiece;

a feeding mechanism for supporting the workpiece and for feeding the workpiece into the device;

a tool electrode having an inner portion and an outer portion and being electrically coupled to the device, the tool electrode being receptive to the workpiece from the feeding mechanism and defining a gap between the workpiece and the inner portion of the tool electrode so that electrolytic byproducts produced during the electrochemical polishing are removed when the nozzle of the device sprays the filtered electrolytic solution into the gap; and a DC power supply having a negative pole and a positive pole, the negative pole being connected with the tool electrode and the positive pole being connected with the workpiece.

2. The apparatus of claim 1, wherein the second tank of the device defines a chamber with a number of walls, one of the walls having an orifice to define an entrance for receiving the workpiece from the feeding mechanism, and wherein the device further comprises a flow meter fluidly coupled to the filter and the tube.

3. The apparatus of claim 2, wherein the second tank has a second periphery, and wherein the feeding mechanism comprises:

a support disposed within the first periphery of the first tank;

a feed roller rotatively disposed on the support and being adapted for feeding the workpiece toward the entrance of the second tank of the device; and a first motor coupled to the feed roller and being adapted for driving the feed roller into rotation to feed the workpiece toward the entrance of the second tank of the device and into the inner portion of the tool electrode, which is disposed within the second periphery of the second tank.

4. The apparatus of claim 3, further comprising: a supporting mechanism disposed within the second periphery of the second tank and being receptive to mating with the tool electrode.

5. The apparatus of claim 4, wherein the supporting mechanism comprises:

a base located within the second periphery of the second tank;

a bearing fixedly disposed on the base;

a sleeve having an annular groove, a distal end, and a proximal end, the proximal end of the sleeve being disposed inside the bearing, and the distal end of the sleeve being receptive to mating with the tool electrode;

a belt placed in the annular groove of the sleeve;

a second motor fixedly disposed on the base for providing rotary power; and a belt pulley mounted on the second motor and being adapted for transmitting the rotary power to the belt to turn the sleeve via the annular groove, thereby driving the tool electrode into rotation to remove the electrolytic byproducts.

6. The apparatus of claim 5, wherein the shape of the inner portion of the tool electrode is adapted to have a mating relationship with the shape of the workpiece.

7. The apparatus of claim 6, wherein the shape of the inner portion of the tool electrode is selected from a group consisting of circular, square and polygonal shapes.

8. The apparatus of claim 7, wherein the size of the inner diameter of the tool electrode is adapted to be bigger than the size of the outer diameter of the workpiece.

9. The apparatus of claim 8, wherein the size of the inner diameter of the tool electrode is adapted to be 0.21~1.0 mm bigger than the size of the outer diameter of the workpiece.

10. A method of electrochemical polishing by a tool electrode, which is adapted for electrochemical polishing a workpiece being continuously processed by a shaping machine, the method comprising:

(a) positioning a portion of the workpiece on a feeding mechanism and positioning the remaining portion of the workpiece on the shaping machine, the workpiece being coupled to a positive pole of a DC power supply;

(b) coupling the tool electrode to a negative pole of the DC power supply;

(c) providing the electrolytic solution to a device for supplying the electrolytic solution to polish the workpiece, the electrolytic solution being composed of about 20%~40% of a compound selected from a group consisting of NaCl and $NaNO_3$;

(d) feeding the workpiece to the device from the feeding mechanism at a predetermined speed;

(e) setting the DC power supply at a desired current, voltage, and pulse; and (f) activating the DC power supply, the device, and the feeding mechanism while the workpiece is being fed at the predetermined speed so that the workpiece is electrochemically polished.

11. The method of claim 10, further comprising: spraying the electrolytic solution at a predetermined angle to strike a predetermined position between the workpiece and the tool electrode so as to remove electrolytic byproducts produced during the act of electrochemical polishing.

12. The method of claim 11, wherein the speed is about 1.5~2.5 mm/min.

13. The method of claim 12, wherein the current is about 5~15 amperes when the average diameter of the workpiece is about 10 mm.

14. The method of claim 13, wherein the voltage is about 10~15V.

15. The method of claim 14, wherein the width of the pulse is about several tenths of a second.

16. The method of claim 15, wherein the feeding mechanism rotates the tool electrode when the workpiece has the shape of a circular rod or a circular tube.

17. The method of claim 16, wherein the speed of the tool electrode is at least about 200 rpm.

18. The method of claim 17, wherein the feeding mechanism is activated when the shape of the workpiece is circular.

* * * * *